US006032627A

United States Patent [19]

Brogdon et al.

[11] Patent Number: 6,032,627

[45] Date of Patent: Mar. 7, 2000

[54] COMPACT VALVE ACTUATION MECHANISM

[75] Inventors: James William Brogdon, Northville; David Keith Gill, Novi, both of Mich.

[73] Assignee: Teledyne Industries, Inc., Los Angeles, Calif.

[21] Appl. No.: 09/123,919

[22] Filed: Jul. 28, 1998

[51] Int. Cl.[7] ..... F01L 1/26

[52] U.S. Cl. ..... 123/90.22; 123/90.33; 123/90.41

[58] Field of Search ..... 123/90.22, 90.33, 123/90.36, 90.39, 90.4, 90.41

[56] References Cited

U.S. PATENT DOCUMENTS

| | | | |
|---|---|---|---|
| 3,179,094 | 4/1965 | Ribeton | 123/90.36 |
| 4,132,196 | 1/1979 | Wherry | 123/90.39 |
| 4,245,523 | 1/1981 | Wherry | 74/579 E |
| 4,327,677 | 5/1982 | Vander Bok | 123/90.4 |
| 4,343,268 | 8/1982 | Strong et al. | 123/90.4 |
| 4,677,723 | 7/1987 | Greene, Sr. | 29/157.1 R |
| 4,848,180 | 7/1989 | Mills | 74/519 |
| 4,940,048 | 7/1990 | Mills | 123/90.39 |
| 4,995,281 | 2/1991 | Allor et al. | 74/559 |
| 5,193,497 | 3/1993 | Hakansson | 123/90.33 |
| 5,207,191 | 5/1993 | Pryba et al. | 123/90.39 |
| 5,537,962 | 7/1996 | Fukuzawa et al. | 123/90.16 |
| 5,553,584 | 9/1996 | Konno | 123/90.16 |
| 5,626,110 | 5/1997 | Regueiro | 123/90.4 |
| 5,671,707 | 9/1997 | Purcell et al. | 123/90.39 |
| 5,692,465 | 12/1997 | Sawanda et al. | 123/90.16 |

OTHER PUBLICATIONS

Three pages of Cummins Engine Co. L/O Engine Manual, Published Jul., 1994.

*Primary Examiner*—Noah P. Kamen
*Attorney, Agent, or Firm*—Robert Pugh; Patrick Viccaro

[57] ABSTRACT

A valve actuation device. The device may include a free floating valve bridge movably supported within a cavity in the engine housing. The bridge may be provided with a cavity and an orifice arrangement for pumping gases entrained with lubricating fluid toward the piston stems as the bridge reciprocates back and forth. The device may also include a rocker arm that has a U-shaped cross-sectional shape for receiving at least a portion of the valve bridge, valve stem valve spring and spring retainer therein. The rocker arm may be provided with lubrication passages for directing lubrication to the point wherein it is pivotally affixed to the engine housing.

42 Claims, 14 Drawing Sheets

FIG. 8
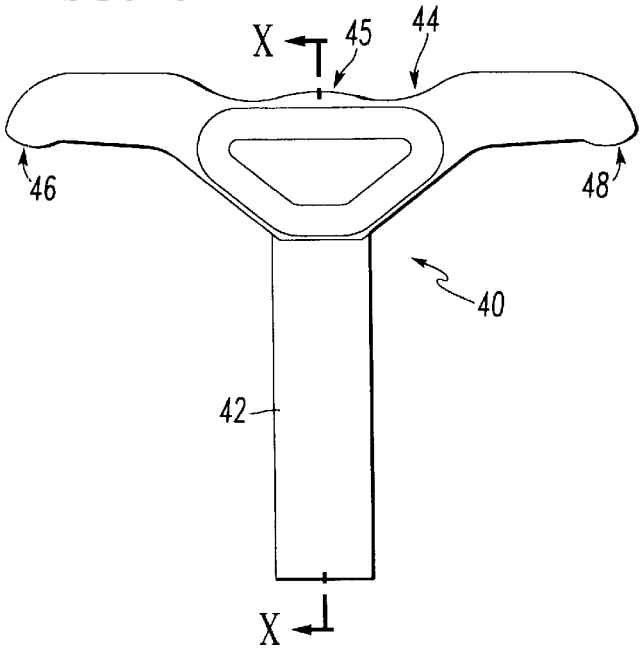
FIG. 9
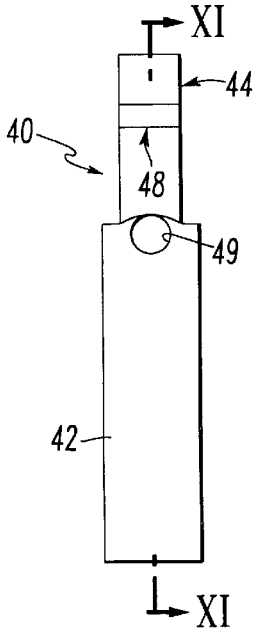
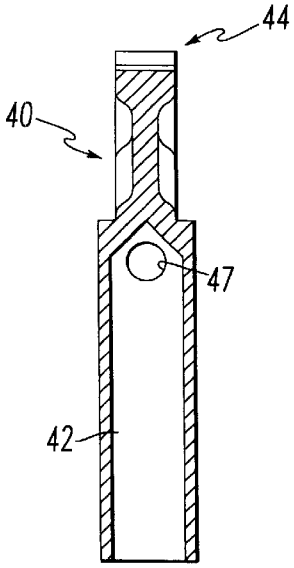
FIG. 10
FIG. 11
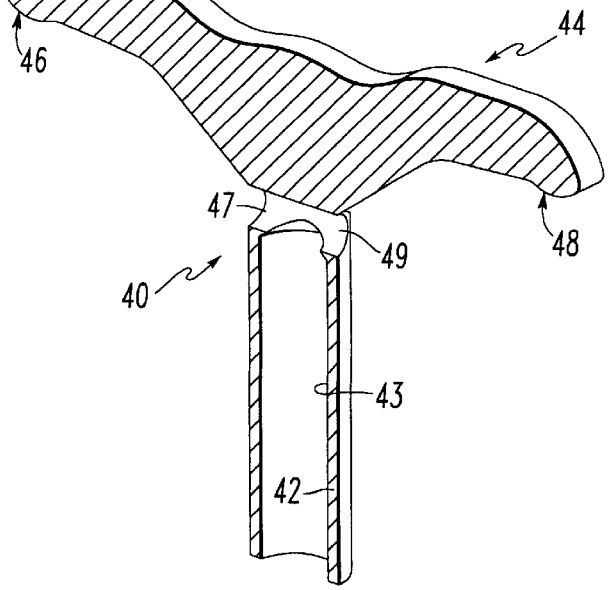

COMPACT VALVE ACTUATION MECHANISM

FEDERALLY SPONSORED RESEARCH

Certain of the research leading to the present invention was sponsored by the United States government under National Aeronautics and Space Administration (NASA) Cooperative Agreement No. NCC3-515. The United States government may have certain rights in this invention.

CROSS-REFERENCE TO RELATED APPLICATIONS

Not applicable.

1. Field of the Invention

The subject invention relates to actuation apparatuses and methods and, more particularly, to apparatuses and methods for actuating the intake or exhaust valves of a piston-driven internal combustion engine.

2. Background of the Invention

Over the years, perhaps due to declining fossil fuel reserves and the resulting increases in fuel prices, engine designers have been challenged to reduce the overall size and weight of vehicle engines while maximizing engine efficiency. It is axiomatic that by utilizing a small and lightweight engine, less space is required to accommodate the engine which can lead to a more compact vehicle design and improvements in fuel efficiency. Such considerations are particularly important when designing, for example, an engine to power an aircraft.

Although the sizes and weights of the components of an engine are important, engine designers must also strive to minimize engine vibrations which can lead to premature failure of components and extensive engine maintenance. In prior engine designs, the components that serve to actuate the engine's valves contributed significantly to the amount of spaced required to accommodate the engine. Valves are used in internal combustion engines to facilitate entry of a fuel and air mixture into a cylinder wherein combustion occurs to fire a piston and to permit the combustion products to be exhausted from the cylinder. The valves are opened in a desired sequence with a collection of interacting components, the construction and operation of which are well known in the art.

FIG. 1 depicts a portion of a conventional internal combustion engine that employs components forming "valve trains" to control the operation of the engine's valves. As shown in FIG. 1, the valves of a conventional engine are received within the engine "block" and their elongated "stems" 2 protrude through the top of the engine, known as the "head" 1. A valve spring 3 is provided around the end of each valve stem 2 and is retained in place by a conventional spring retainer 4. The valve spring 3 retains the valve in a closed position until it is biased open by a corresponding member, known as a "valve bridge"5. Each valve bridge 5 is mounted on a corresponding post attached to the engine head. The bridge 5 is machined to closely fit around the post for slidable travel thereon and extends between a corresponding pair of valve stems 2 for contact therewith. The bridge 5 is free to move up and down and, by virtue of its contact with the valve stems 2, biases each corresponding valve downward into the cylinder to open its respective port therein.

It will be appreciated that the distance that each valve stem protrudes out of the head can depend upon the amount of friction generated between the valve guide that supports the valve stem and the valve stem. Thus, the valve stems generally do not each protrude out of the head a uniform distance. One method for accommodating the variations in valve stem heights involved the provision of an adjustment screw 6 on the bridge 5. To compensate for the distance between one end of the valve bridge 5 and its corresponding valve stem, the adjustment screw is screwed toward the stem until it reaches a desired position and thereafter it is locked in position with a lock nut 7.

The valve bridges 5 are actuated by corresponding rocker arms 10 that are pivotally affixed to the engine block 1. Each rocker arm is pivotally affixed at its center and has a contact tip 12 formed on one end thereof for contacting a corresponding valve bridge 5. The other end of the rocker arm 10 is configured to receive a portion of a corresponding pushrod 14 therein. The skilled artisan will appreciate that the pushrod 14 is actuated by a cam arrangement within the engine to cause the rocker arm 10 and corresponding bridge 5 to open the valves at predetermined intervals.

A conventional rocker arm 10 is depicted in FIGS. 2 and 3. Conventional rocker arms are commonly configured with a contact tip 12 and a pushrod pocket 13. A pivot bore 16 is provided through the rocker arm 10 to facilitate pivotal travel about a mounting rod 9. See FIG. 1. Such rocker arm configuration places all of the structure of the valve side of the rocker arm (that portion which is between the rocker arm tip 12 and the edge of the valve spring retainer closest to rocker arm pivot) above the valve spring retainer. This has been done to provide a relatively strong and stiff mechanism for transferring pushrod or cam motion into valve motion. The stiffness of the rocker arm is generally most influenced by the "section height" of the rocker arm. The section height is the depth of the rocker arm approximately perpendicular to the valve stem axis. Such height undesirably contributes to the overall height and weight of the engine.

The "guided" valve bridge arrangement described above has disadvantages. While its does provide for a means to compensate for different valve stem heights, the use of adjusting screws undesirably add to the weight and overall cost of the engine. In addition, the mounting post and valve bridge must be machined to relatively close tolerances to ensure that the bridge freely travels on the post. Such close tolerance machining can lead to increased engine manufacturing costs.

In an effort to address such problems associated with guided valve bridges, "floating" bridges have been developed. Such a bridge, however, lacks a means for guiding the bridge in a direction that is parallel to the axes of the valve stems. Thus, while such bridges are simpler in construction than the guided bridges, they offer no method of compensation for non-uniform valve stem heights caused by irregular amounts of friction between the valves and their respective valve guides.

Thus, there is a need for a valve actuation mechanism that is of reduced size and weight to thereby enable the spaced occupied by the engine to be reduced.

There is a further need for a valve actuation mechanism that is of reduced complexity and less costly to manufacture and install.

Another need exists for a means for promoting engine cooling the area around the valve stems.

There is still another need for a valve actuation mechanism with the above mentioned characteristics that is durable, reliable, and relatively easy to manufacture and service.

SUMMARY OF THE INVENTION

In accordance with a particularly preferred form of the present invention, there is provided an actuator for transmitting an actuation force to at least one elongated member movably received within a housing having a support cavity adjacent to at least one elongated member. In a preferred form, the actuator comprises an actuator stem sized to be movably received in the support cavity along a first axis that is substantially parallel to a second axis of at least one elongated member. The actuator further comprises a force-receiving portion attached to the actuator stem and oriented to contact at least one elongated member when a force is applied thereto.

Another embodiment of the present invention comprises an actuator for transmitting an actuation force to at least one elongated member movably received within a housing. The actuator comprises a support cavity within the housing adjacent to at least one elongated member and an actuator stem sized to be movably received in the support cavity such that a predetermined amount of clearance is provided between the support cavity and the actuator stem. The actuator further comprises a force-receiving portion attached to the actuator stem and oriented to contact at least one elongated member when a force is applied to the force receiving portion.

Yet another embodiment of the present invention comprises a valve bridge for applying a force to at least two valve stems that are supported within an engine and that each define a corresponding stem axis. The valve bridge comprises a support cavity in the engine adjacent at least two valve stems and defining an actuation axis that is substantially parallel to the stem axes. The valve bridge also includes a bridge stem sized to be slidably received within the support cavity and a cross member affixed to the bridge stem. The cross member is sized to contact two valve stems upon an application of a force to the cross member.

The present invention also includes apparatus for circulating a gas adjacent at least one valve stem that is movably supported within an engine. The apparatus comprises a support cavity within the engine adjacent to at least a portion of at least one valve stem and a reciprocating actuator within said support cavity. The reciprocating actuator has an actuator cavity therein and at least one orifice therethrough. The actuator cavity and support cavity cooperate to form a gas chamber for receiving and expelling gas therefrom through the orifices as the actuator reciprocates within the support cavity.

The present invention also comprises an internal combustion engine that includes a housing and at least two valves that are movably supported in the housing. Each valve has a valve stem that defines a corresponding valve stem axis. The engine also includes at least one support cavity within the housing that is centrally disposed between at least two valve stems. The support cavity defines an actuation axis that is substantially parallel to the valve stem axes. A T-shaped valve bridge, corresponding to each support cavity and having a bridge stem sized to be slidably received within the corresponding support cavity, is also provided. Each valve bridge has a cross member sized to contact at least two valve stems. The engine also includes at least one rocker arm corresponding to each valve bridge. Each rocker arm has a contact surface for contacting the corresponding valve bridge. The engine further includes a reciprocating pushrod contacting each rocker arm.

Another embodiment of the present invention includes a rocker arm for transmitting a force to at least one valve stem operably mounted within an engine. In a preferred form, the rocker arm comprises a body portion having an elongated cavity formed therein and a contact surface formed on the body portion for contacting the valve stem. The rocker arm also includes a connection portion for pivotally attaching the rocker arm to the engine.

Yet another embodiment of the present invention includes a rocker arm for transmitting an actuation force from an engine pushrod to a valve bridge oriented between a pair of piston stems protruding out of a portion of the engine housing. The rocker arm comprises a body portion having a cavity therein sized to receive at least a portion of the valve bridge therein. In addition, the rocker arm includes a connector for pivotally attaching the rocker arm to the engine housing and a contact surface on the body portion for contacting a portion of the valve bridge.

The present invention comprises an internal combustion engine that has an engine housing and t least two valves movably supported in the housing. Each valve has a valve stem that defines a corresponding valve stem axis. The engine further includes at least one support cavity within the housing that is centrally disposed between at least two valve stems and serves to define an actuation axis that is substantially parallel to the valve stem axes. The engine also includes a T-shaped valve bridge that corresponds to a support cavity and has a bridge stem sized to be slidably received within the corresponding support cavity. Each valve bridge has a cross member sized to contact at least two valve stems. In addition, a rocker arm is pivotally attached to the housing and to contact a portion of the valve bridge. The rocker arm has a cavity therein for receiving a portion of the valve bridge therein. The engine also has a reciprocating pushrod in contact with the rocker arm.

The present invention also comprises a valve actuation device for an internal combustion engine that has at least two valves and at least one reciprocating pushrod. The valves each have a valve stem that protrudes through a portion of the engine housing and serves to define a corresponding valve stem axis. The actuation device comprises a support cavity in the engine adjacent at least two valve stems. The support cavity defines an actuation axis that is substantially parallel to the stem axes. The device also includes a bridge stem sized to be slidably received within the support cavity. The device further comprises a rocker arm pivotally attached to the engine housing for contact with the reciprocating pushrod and the valve bridge. The rocker arm has a cavity therein for receiving a portion of the valve bridge therein.

It is a feature of the present invention to provide an actuator bridge for applying a force to a plurality of valve stems that is economical to manufacture and install.

It is another feature of the present invention to provide a valve bridge that can facilitate engine cooling.

Yet another feature of the present invention is to provide a rocker arm that requires less space within the engine compartment than is typically required to accommodate conventional rocker arms.

Still another feature of the present invention is to provide a rocker arm that employs a unique method for directing lubrication fluid/gases to the rocker arm's point of attachment to the engine head to reduce friction therebetween.

Another feature of the present invention is to provide a valve actuation device that is lighter and more compact than conventional valve actuation devices.

It is another feature of the present invention to provide a valve actuation device that can lead to improved engine efficiencies.

Accordingly, the present invention provides solutions to the shortcomings of prior valve bridges, rocker arms and valve actuation devices. Those of ordinary skill in the art will readily appreciate, however, that these and other details, features and advantages will become further apparent as the following detailed description of the preferred embodiments proceeds.

BRIEF DESCRIPTION OF THE DRAWINGS

In the accompanying Figures, there are shown present preferred embodiments of the invention wherein like reference numerals are employed to designate like parts and wherein:

FIG. 8 is a front elevational view of a valve bridge of the present invention;

FIG. 9 is a right side elevational view of the valve bridge of FIG. 8;

FIG. 10 is a cross-sectional view of the valve bridge of FIGS. 8 and 9, taken along line X—X in FIG. 8;

FIG. 11 is a cross-sectional view of the valve bridge of FIGS. 8–10 taken along line XI—XI in FIG. 9;

DETAILED DESCRIPTION OF EMBODIMENTS OF THE INVENTION

Figure 1:
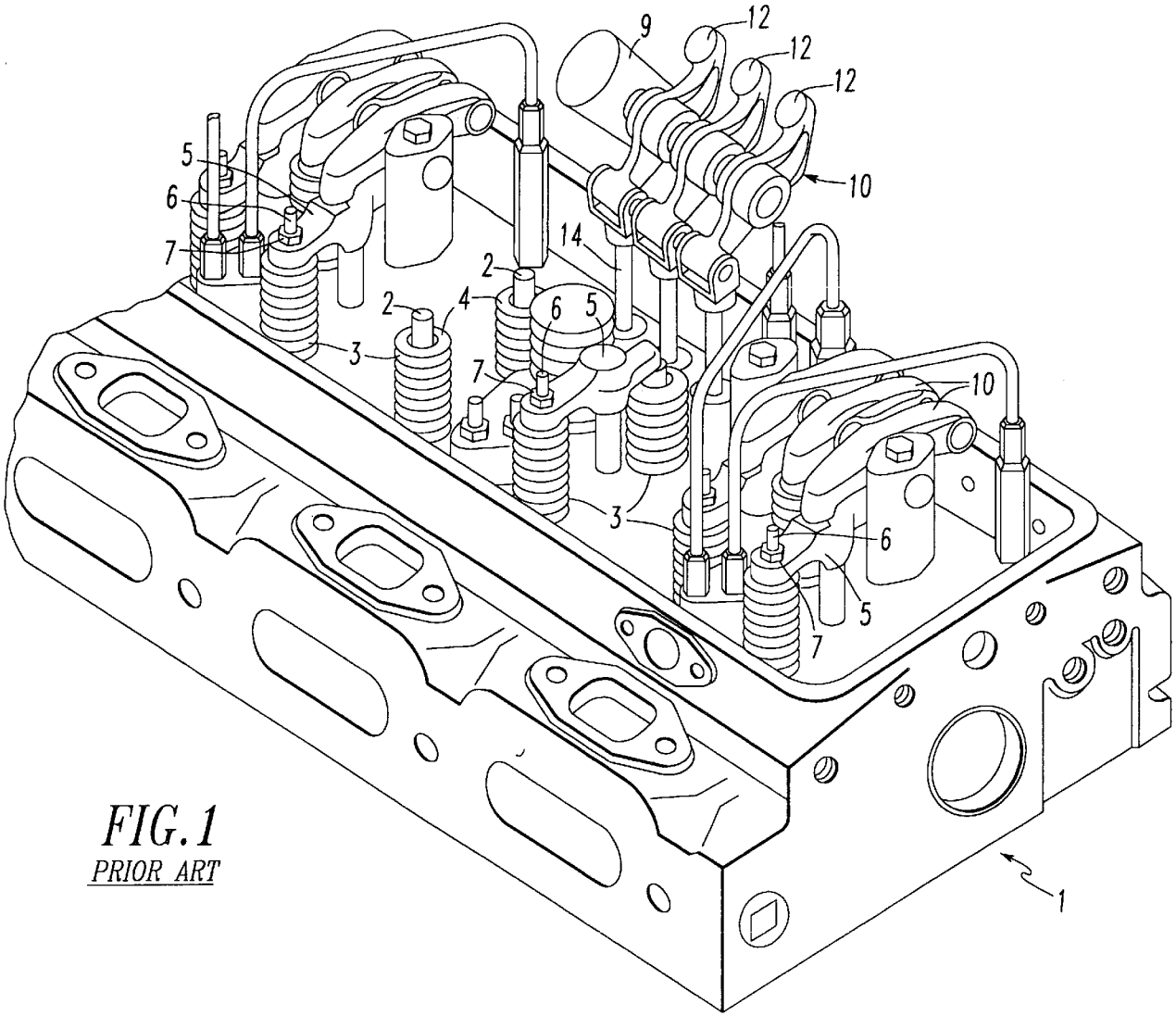
FIG. 1 PRIOR ART
FIG. 1 is a partial perspective view of a portion of a conventional engine.
Figure 2:
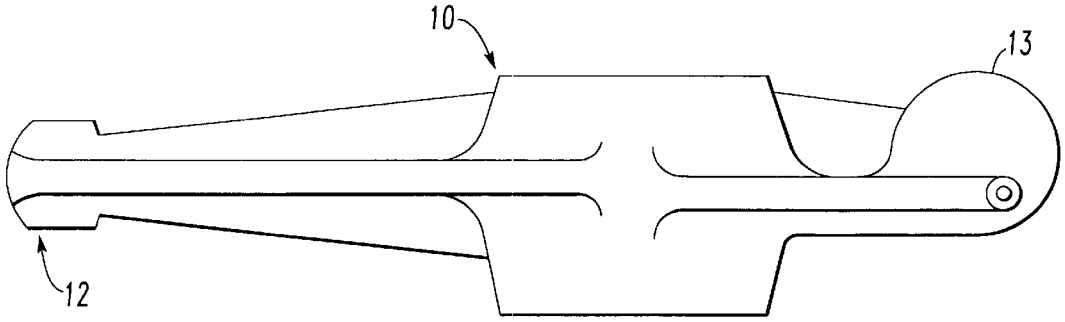
FIG. 2 PRIOR ART
FIG. 2 is a top view of a conventional rocker arm employed in the engine depicted in FIG. 1.
Figure 3:
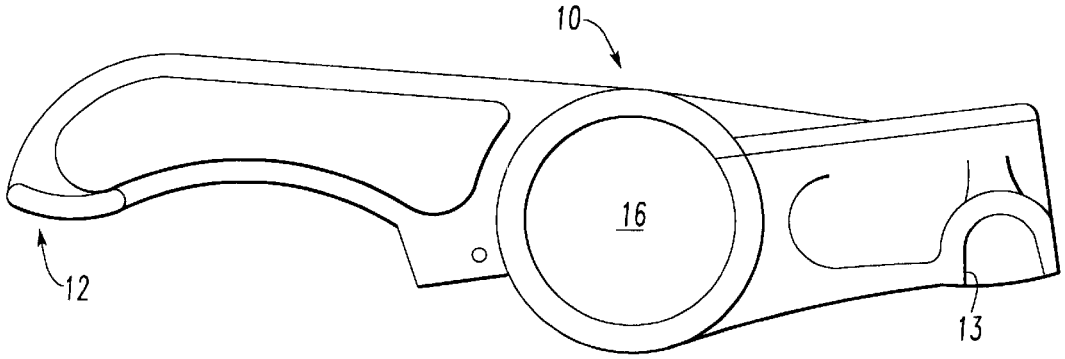
FIG. 3 PRIOR ART
FIG. 3 is a side view of the conventional rocker arm of FIG. 2.
Figure 4:
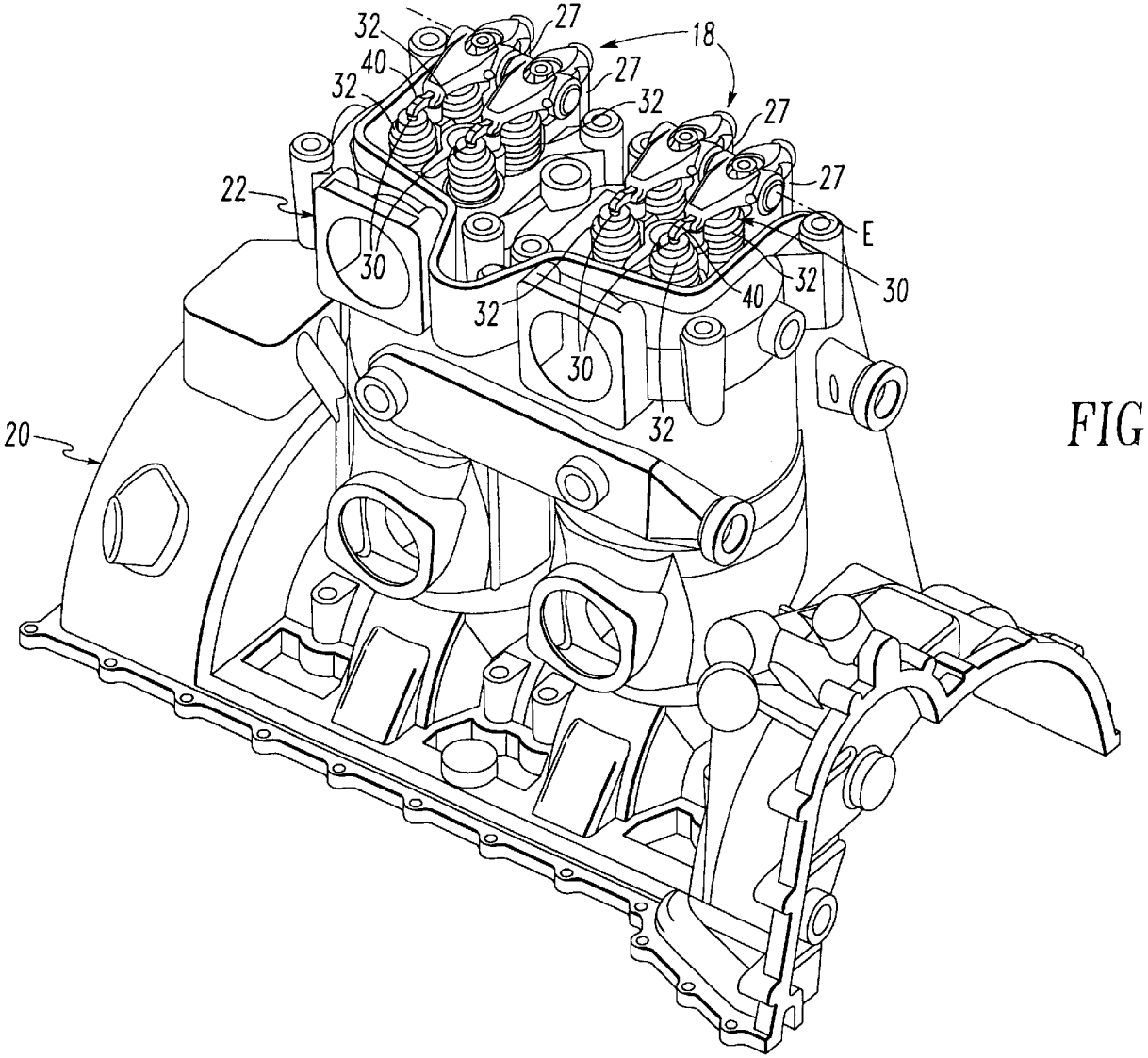
FIG. 4 is a partial perspective view of a valve actuation mechanism of the present invention in use on an engine block of a piston-drive internal combustion engine.
Figure 5:
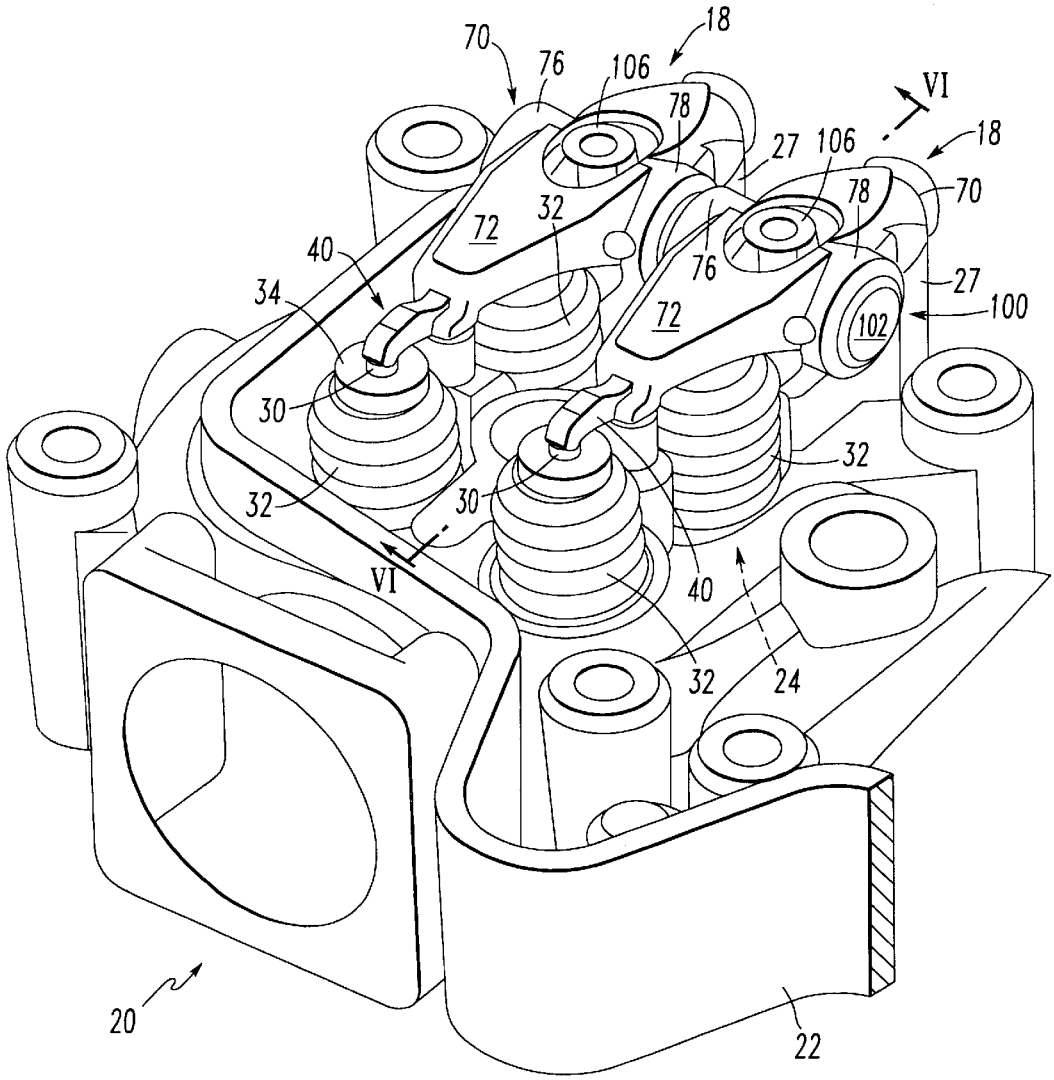
FIG. 5 is a partial perspective view of the engine and valve actuation mechanism of FIG. 4.
Figure 6:
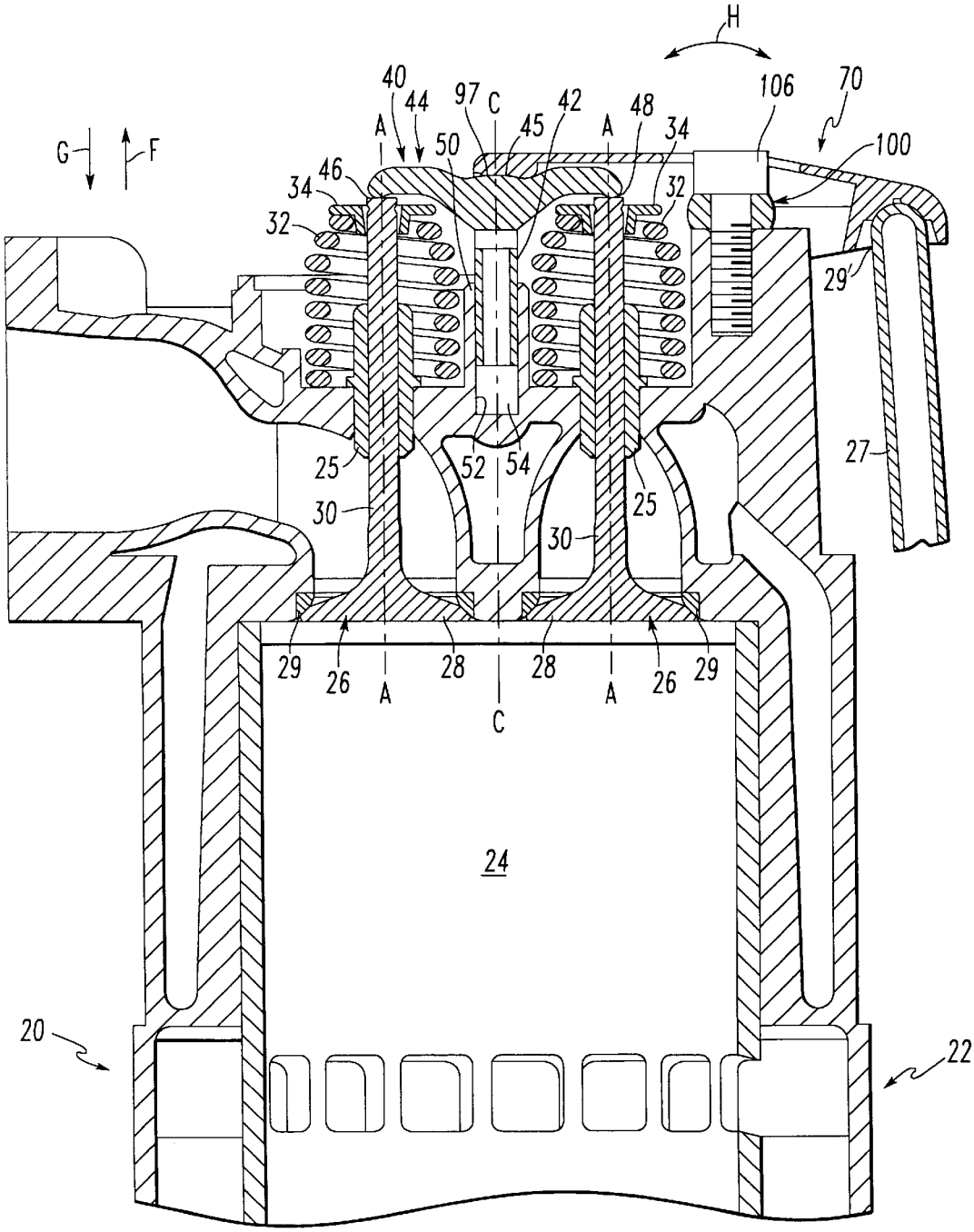
FIG. 6 is a partial cross-sectional view through a cylinder of the engine depicted in FIGS. 4 and 5 taken along line VI—VI in FIG. 5.

Referring now to the drawings for the purposes of illustrating present embodiments of the invention only and not for the purposes of limiting the same, the FIGS. 4–6 show a valve actuation mechanism 18 of the present invention used in connection with a piston-driven internal combustion engine 20 that has a cylinder head 22 with a total of four cylinders 24 therein. While the present invention is particularly well-suited for actuating the intake or exhaust valves of a piston-driven internal combustion engine 20, one of ordinary skill in the art will appreciate that the unique valve bridge and rocker arm embodiments of the present invention disclosed herein could be successfully employed in myriad of other applications in which the actuation of valves of varying types is required. Accordingly, the protection afforded to the present preferred embodiments disclosed and claimed herein should not be limited solely to use in connection with the engine 20 of the type depicted in the present Figures. The construction and operation of the piston-driven internal combustion engine 20 used herein to help describe the present invention, is well known in the art and will not be discussed in detail herein. Accordingly, only those portions of the engine 20 necessary to illustrate the embodiments of the present invention are discussed below.

The engine 20 depicted in FIGS. 4–6, has a total of four cylinders 24 that are each serviced by a pair of corresponding valves 26. Each valve 26 includes a valve head 28 that is adapted to sealingly engage a corresponding valve seat 23 in the cylinder head 22. Each valve 26 further includes a stem 30 that is slidably supported in a valve guide member 25 that is affixed to the cylinder head 22. Each valve guide member 25 serves to slidably support the corresponding valve stem 30 therein along an axis A—A. See FIG. 6. The engine 20 includes pushrods 27 for actuating a corresponding pair of valves 26 therein. Each valve 26 is also provided with a valve spring 32 that is coaxially received around its valve stem 30. The upper portion of each valve stem 30 is fitted with a conventional spring retainer member 34 for retaining the spring 32 in position to bias the valve 26 into sealing engagement with its respective seat 29. See FIG. 6.

A preferred valve actuator or bridge 40 of the present invention will now be described with reference to FIGS. 5–12. As can be seen in those Figures, bridge 40 comprises a T-shaped member that includes a stem portion 42 and a cross or bridge member 44. Those of ordinary skill in the art will appreciate that the bridge 40 may be fabricated from steel or other suitable material. Contact faces (46, 48) are preferably formed on each end of the bridge member 44 for contact with the end of a corresponding valve stem 30.

Figure 12:
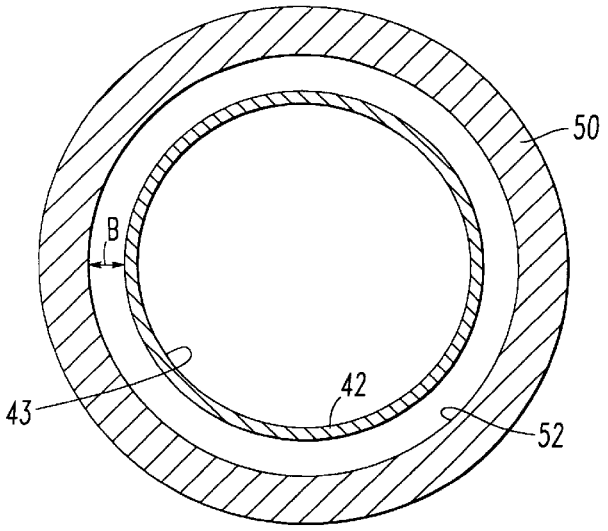
FIG. 12 is a partial cross-sectional plan view of a bridge stem received in a bridge support member formed in an engine.

As can be seen in FIGS. 6 and 12, the bridge stem 42 is sized to be slidably received within a bridge support member 50 formed in the cylinder head 22. Bridge support member 50 has a bore 52 therein that is sized to receive the bridge stem 42 therein. In a preferred embodiment, a clearance of approximately 0.002"–0.003" (represented by distance B in FIG. 12) is provided between the outer surface of the bridge stem 42 and the inner surface of the bore 52 to facilitating sliding and "free floating" travel of the bridge stem 42 within the bore 52. However, other amounts of clearance "B" between the bridge stem 42 and the bore 52 may be successfully employed. As can be seen in FIG. 6, the bridge support preferably supports the bridge stem 42 along an axis C—C that is substantially parallel to the stem axes A—A. However, because of the clearance between the bore 52 and the bridge stem 42, the bridge stem 42 (and bridge member 44) may be tilted laterally within bore 52 such that the bridge stem 42 is not coaxial with the bore 52. The skilled artisan will appreciate that, in general, the amount of clearance between the bridge stem and the support cavity is dependent upon the length of the bridge stem. That is, the clearance between the bridge stem and the support cavity will decrease as the bridge stem length decreases. Thus, it will be appreciated by the skilled artisan that, in the situation in which the distances that the valve stems 30 each protrude out of their respective valve guides 25 are not equal (due to, for example, greater friction between one of the valve stems 30 and its respective valve guide 25), the bridge stem 42 is free to pivot slightly within the bridge support member 50 to enable the bridge 40 to accommodate such differences in stem heights and maintain equal contact pressure on the valve stems 30. Thus, the bridge stem 42 is "free floating" within the bridge support member 50. The skilled artisan will, therefore, appreciate that the bridge 40 thereby operates to open and close a corresponding pair of valves 26 in unison, thus obviating the need for apparatus such as an adjusting screw to ensure contact between the valve bridge 40 and each corresponding valve stem 30. In a preferred embodiment, the bridge stem 42 is sized relative to the bore 52 such that the clearance "B" therebetween permits the bridge to maintain equal contact with each valve stem 30 regardless of slight variations in valve stem height and apply a force to each valve stem 30 that lies generally along the valve stem axis A—A.

In a preferred embodiment, bridge stem 42 also has an open ended cavity 43 therein that cooperates with bore 52 to form a pump chamber 54 within bridge support member 50. See FIGS. 6, 10 and 11. The exterior surface of the bridge stem 42 additionally includes two orifices 47 and 49 that are oriented on opposite sides of the bridge stem 42 and communicate with cavity 43. The orifices 47 and 49 are in fluid communication with the chamber 54. Orifices 47 and 49 are adapted to direct a flow of gases that are typically entrained with lubrication fluid (i.e., engine oil) received within the chamber 54 toward the ends of the adjacent valve stems 30 as the bridge stem 52 reciprocates within the bridge support member 50. In particular, when the bridge stem 42 is received within the bridge support 50, orifices (47, 49) are positioned in the direction of the adjacent valve springs 32. As the bridge 40 is forced upward (represented by arrow "F" in FIG. 6) by the valve stems 30, gases entrained with lubricating fluid (i.e., engine oil) are drawn into the chamber 54, and as the bridge is biased downward (represented by arrow "G" in FIG. 6), at least a portion of those gases within the chamber 54 is forced outward through the orifices (47, 49) toward the springs 32 and the tops of the adjacent valve stems 30. Thus, the bridge 50 may be advantageously constructed to act as a piston pump for circulating gases and lubrication fluid in the vicinity of the valve stems 30, springs 32 and valve guides 25 which can promote engine cooling.

Accordingly, the bridge 40 of the present invention represents a vast improvement over prior valve bridge designs. In particular, the present valve bridge is relatively easy to manufacture and install. It also has the unique capability of accommodating different valve stem heights without the need for complicated adjustment screw arrangements. Therefore, the valve bridge of the present invention leads to a lighter, more compact and less expensive engine. The subject valve bridge also provides the novel capability of promoting engine cooling by moving gases and lubrication fluid in an around the valve springs and valve stems.

A preferred valve actuation mechanism may also employ at least one unique and novel rock arm 70 for actuating the valve bridges 40. While the valve actuation mechanism 18 depicted and described herein employs the unique and novel rocker arms 70 of the present invention for actuating the present valve bridges 40, those of ordinary skill in the art will, of course, appreciate that the unique valve bridges 40 described herein may be actuated with conventional rocker arm arrangements, if so desired.

The construction and operation of a preferred rocker arm 70 of the valve actuating assembly of the present invention will now be described. As shown in FIG. 6, the rocker arm 70 is preferably constructed and so oriented to envelop a portion of the bridge 40, and upper portions of a corresponding valve stem 30, spring 32 and spring retainer 34 located adjacent to the rocker arm's point of attachment to the cylinder head 22. As can be seen in FIGS. 13–23, in a preferred form, the rocker arm 70 is machined from a single piece of material such as steel or the like and includes a forward bridge-engaging portion 71 and a rear pushrod receiving end 73. Rocker arm 70 further has a top portion 72 and two generally parallel side walls 74 and 75 which serve to define an elongated cavity 79 within the rocker arm 70. Such particularly advantageous construction provides the rocker arm 70 with a generally U-shaped cross-section throughout its length. See FIG. 22. It will be apparent to the skilled artisan that such enveloping of a portion of the bridge 40, the top of the valve stem 30 and valve spring 32 within the U-shaped rocker arm 70 represents an improvement over prior rocker arm configurations in that it allows the overall height of the valve actuation mechanism 18 to be reduced without also decreasing the cross-sectional height of the rocker arm 70.

The extent to which the rocker arm 70 envelopes the top of one of the valve springs 32 can be further increased by increasing the distance between the sidewalls 74 and 75 such that the top portion of the spring and spring retainer are received within the cavity 79 in rocker arm 70 and/or employing a conically-shaped spring 32 as shown in FIG. 6. Reducing the diameter of the valve spring 32 also permits placement of the rocker arm support member 100, upon which the rocker arm 70 is pivotally journaled, closer to innermost valve spring 32. Accordingly, the distance that must be spanned by the rocker arm 70 to engage the bridge 40 is also advantageously reduced. Thus, such arrangement enables shorter and stiffer rocker arms to be employed.

Figure 7:
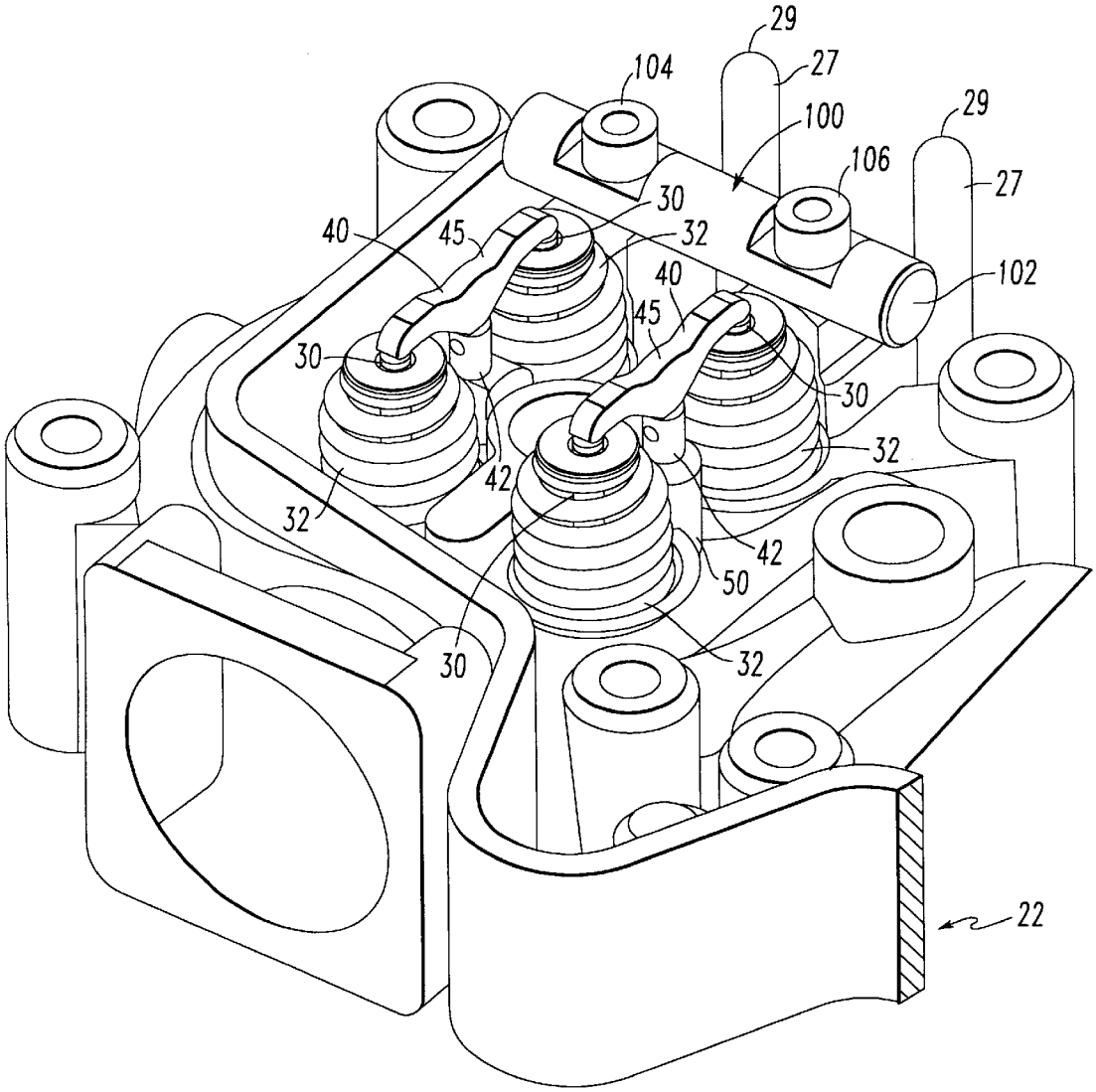
FIG. 7 is another partial perspective view of the engine and valve actuation device depicted in FIG. 5, with the rocker arms of the present invention removed for clarity.
Figure 13:
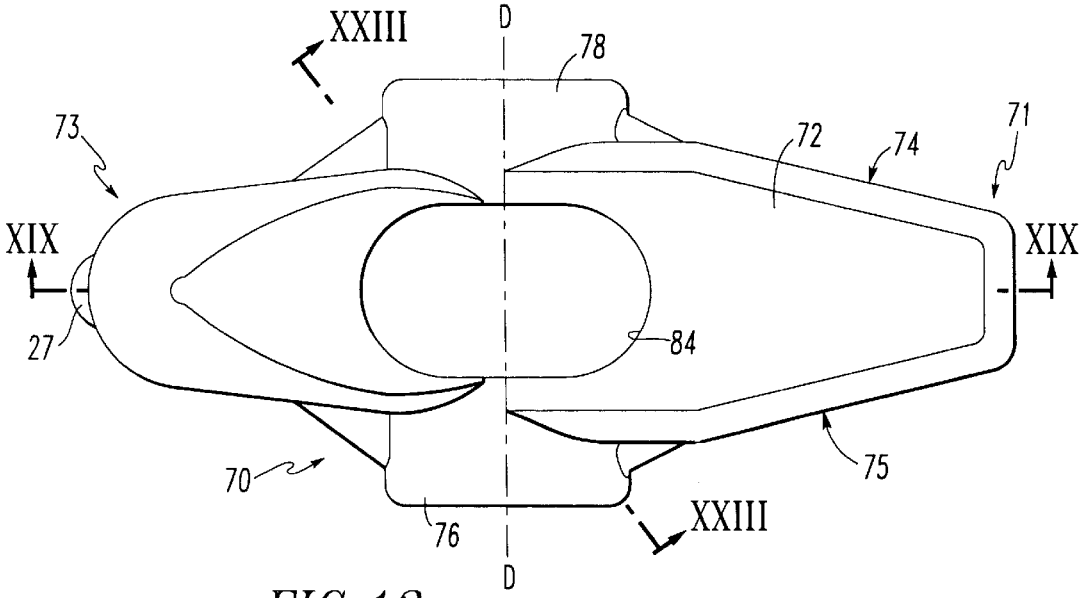
FIG. 13 is a plan view of a rocker arm of the present invention and a pushrod.
Figure 14:
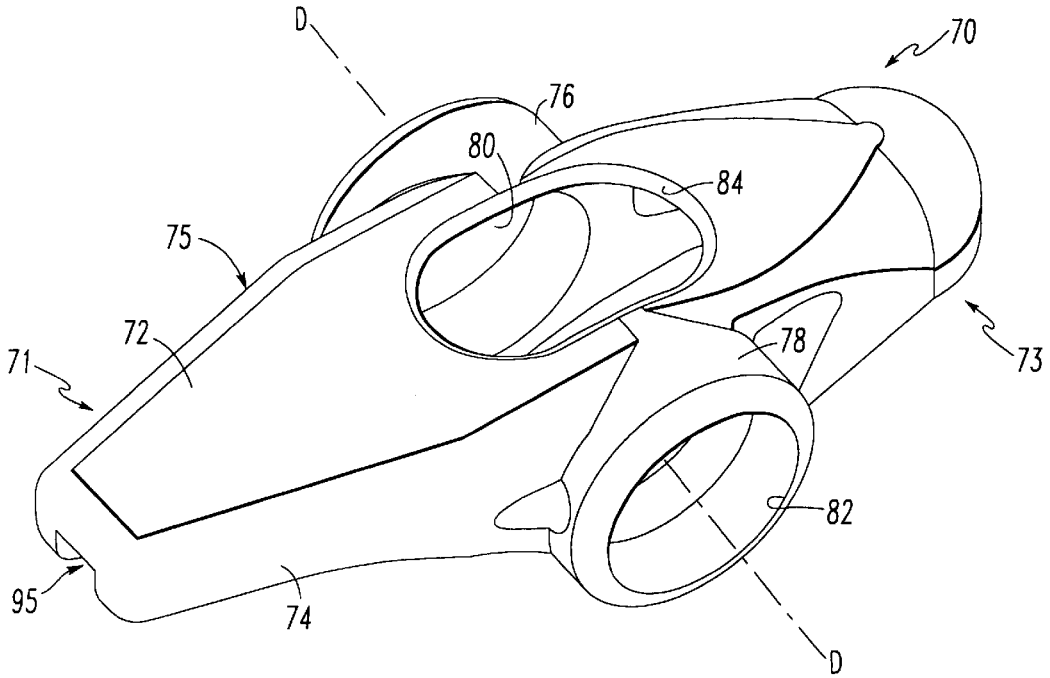
FIG. 14 is a perspective view of the rocker arm depicted in FIG. 13.
Figure 15:
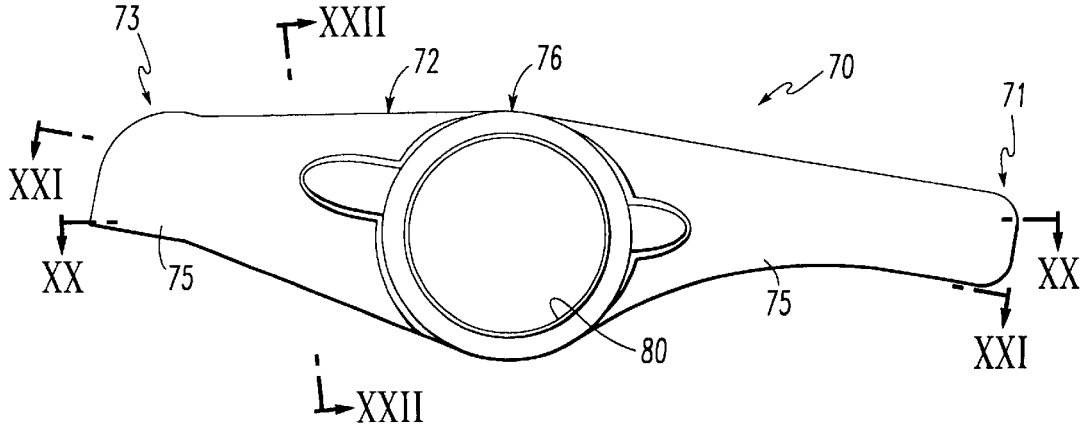
FIG. 15 is a side view of a rocker arm of the present invention.
Figure 16:
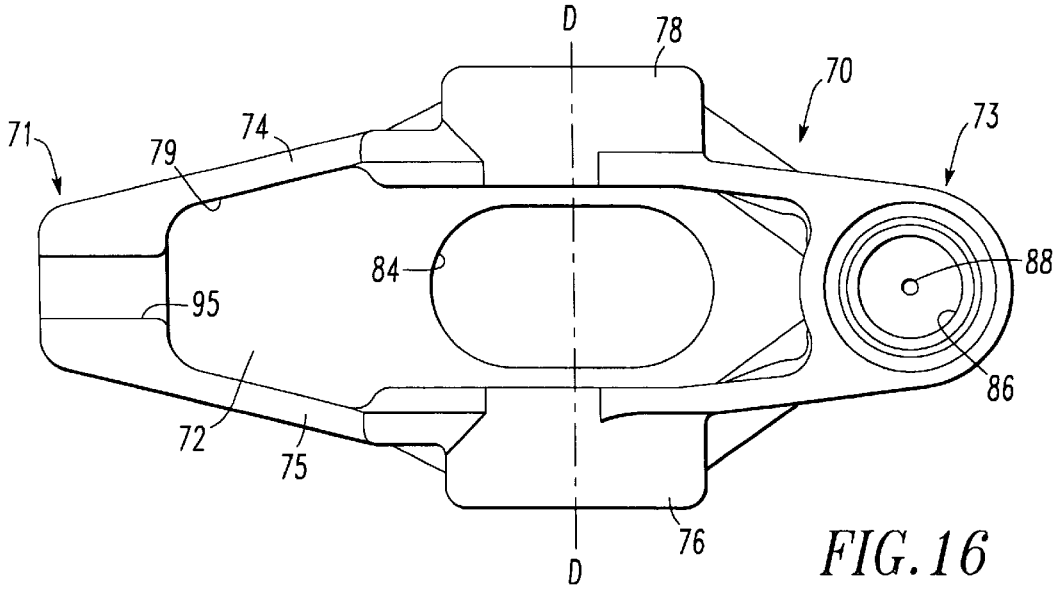
FIG. 16 is a bottom view of the rocker arm of FIGS. 13–15.
Figure 17:
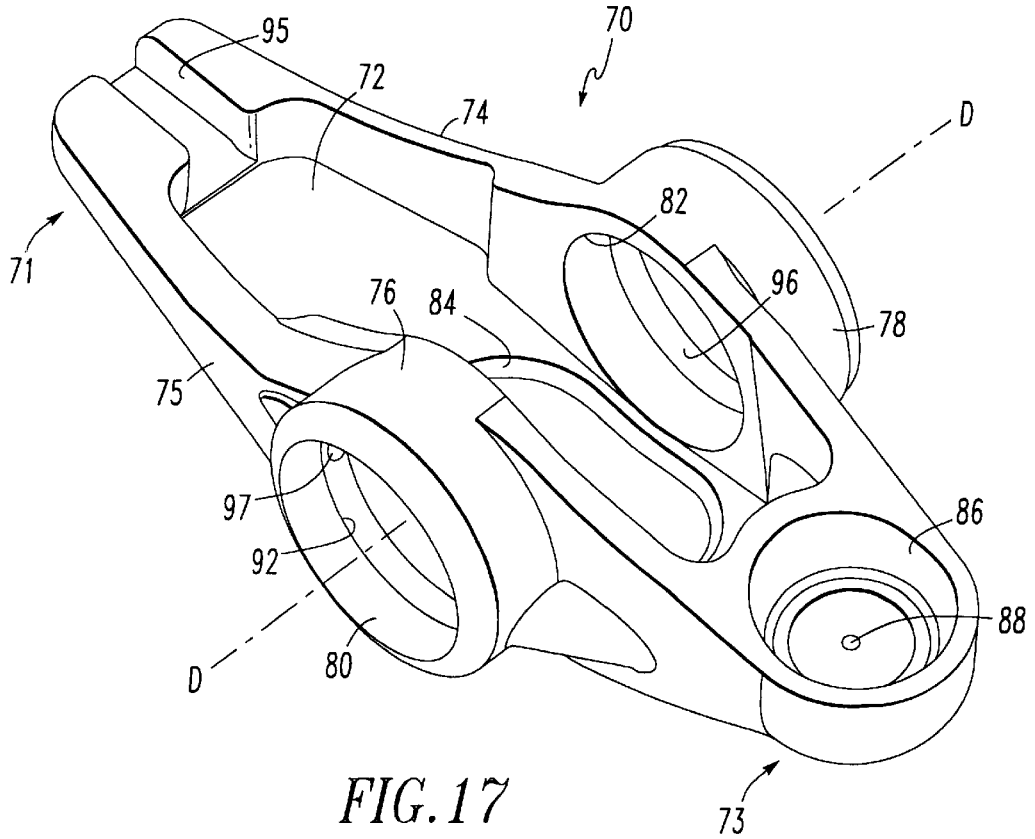
FIG. 17 is a perspective view of the bottom of the rocker arm depicted in FIGS. 13–16.
Figure 18:
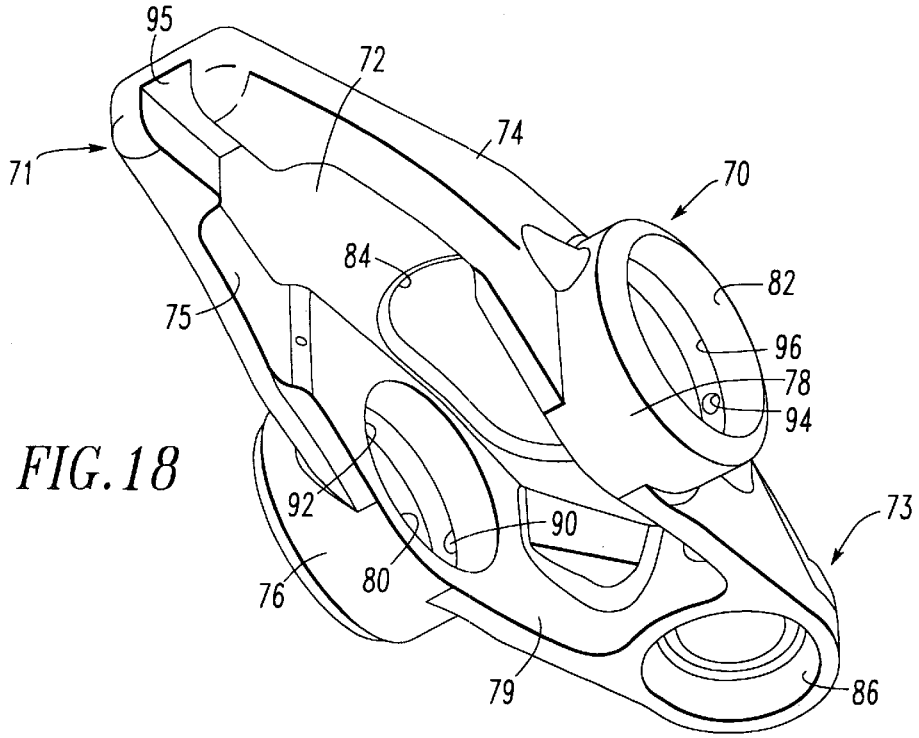
FIG. 18 is another perspective view of the bottom of the rocker arm depicted in FIGS. 13–17.

As can be seen in FIGS. 5 and 7, the rocker arm 70 is pivotally mounted on the rocker arm support member 100 which is also preferably fabricated from a rigid material such as steel or the like. The rocker arm support member 100 is positioned on the cylinder head 22 in close proximity to the valve springs 32. Rocker arm support member 100 includes a transverse rod member 102, fixed in place on the cylinder head 22 by conventional anchors 104 and 106. To facilitate mounting of rocker arm 70 on the transverse rod member 102, rocker arm 70 has a first journal portion 76 integrally formed on lateral side 75. Journal portion 76 has a bore 80 therethrough. Similarly, a second journal portion 78 is integrally formed in side wall 74 and has a bore 82 therethrough. Bores (82, 84) are coaxially aligned on axis D—D as shown in FIG. 13 to enable the rocker arm 70 to be pivotally mounted on the transverse rod member 102.

To accommodate the portions of the conventional anchors 104 and 106 without increasing the overall height of the valve actuation mechanism 18, an elongated opening 84 is provided in the top 72 of each rocker arm 70. Each rocker arm 70 is pivotally mounted on transverse rod member 102 such that the top portions of the corresponding anchors 104, 106 can protrude through the elongated opening 84. It will be understood by the skilled artisan that, while the Figures depict two rocker arms 70 pivotally mounted on each rocker arm support 100, the apparatus and concepts disclosed herein could be employed to accommodate greater or fewer than two rocker arms 70 pivotally mounted to the engine cylinder head 22.

Figure 19:
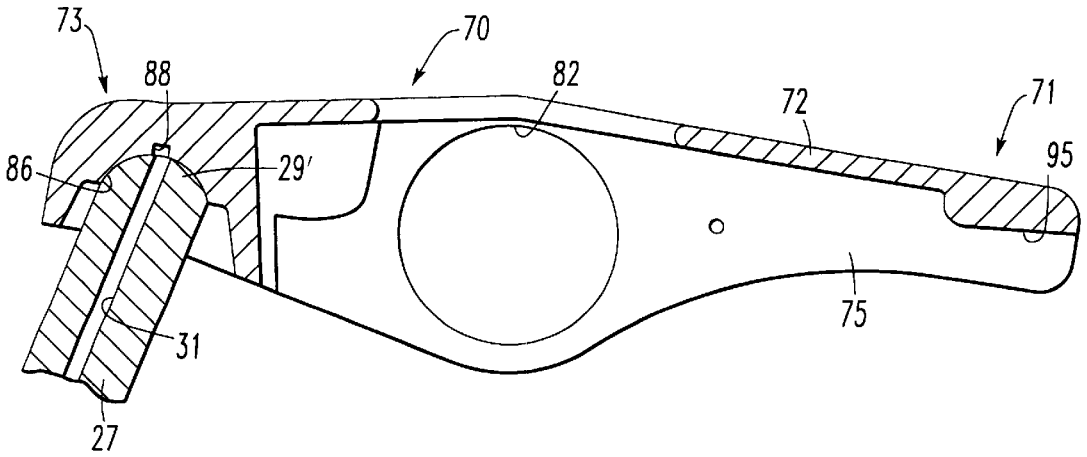
FIG. 19 is a cross-sectional view of the rocker arm and pushrod of FIG. 12 taken along line XIX—XIX in FIG. 12.

As can be seen in FIGS. 16–20, rocker arm 70 may also include a cavity 86 at one end that is adapted to accept the end 29' of a pushrod 27. Accordingly, the size and shape of the cavity 86 preferably conforms to that of the end 29' of a pushrod 27. Preferably, both the cavity 86 and the end 29' of the pushrod 27 have complementary hemispherical shapes. As shown in FIG. 19, the end 29' of the pushrod 27 is received within the cavity 86 in close communication therewith. Actuation of the pushrod 27 in a known manner during the operation of engine 20 thus causes rocker arm 70 to pivot about transverse rod member 102. Such pivotal travel of the rocker arms 70 about transverse rod member 102 is represented by arrow "H" in FIG. 6.

Figure 20:
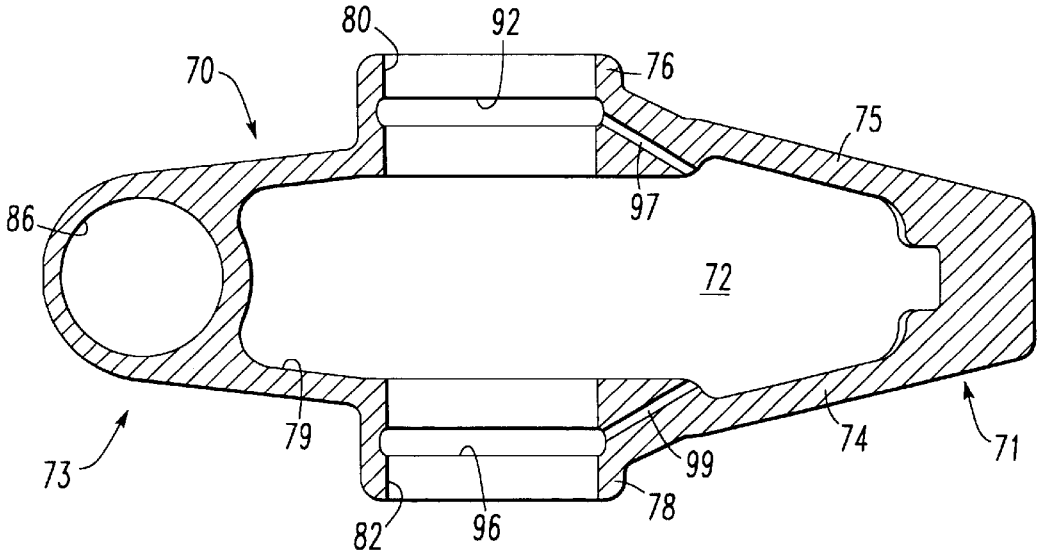
FIG. 20 is a cross-sectional view of the rocker arm depicted in FIG. 15, taken along line XX—XX in FIG. 15.
Figure 21:
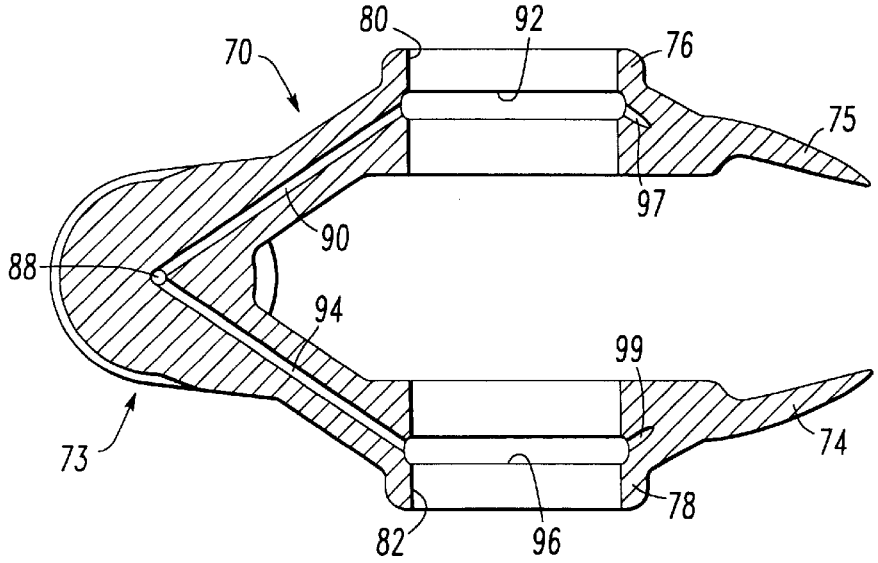
FIG. 21 is another cross-sectional view of the rocker arm depicted in FIG. 15 taken along line XXI—XXI in FIG. 15.
Figure 22:
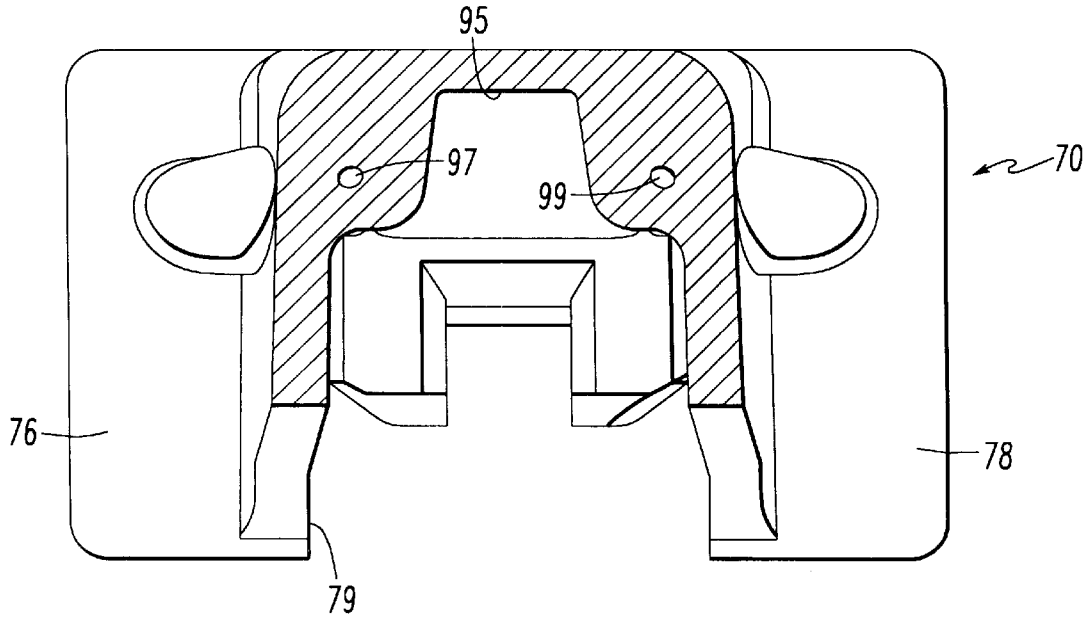
FIG. 22 is an end cross-sectional view of the rocker arm depicted in FIG. 15 taken along line XXII—XXII in FIG. 15.
Figure 23:
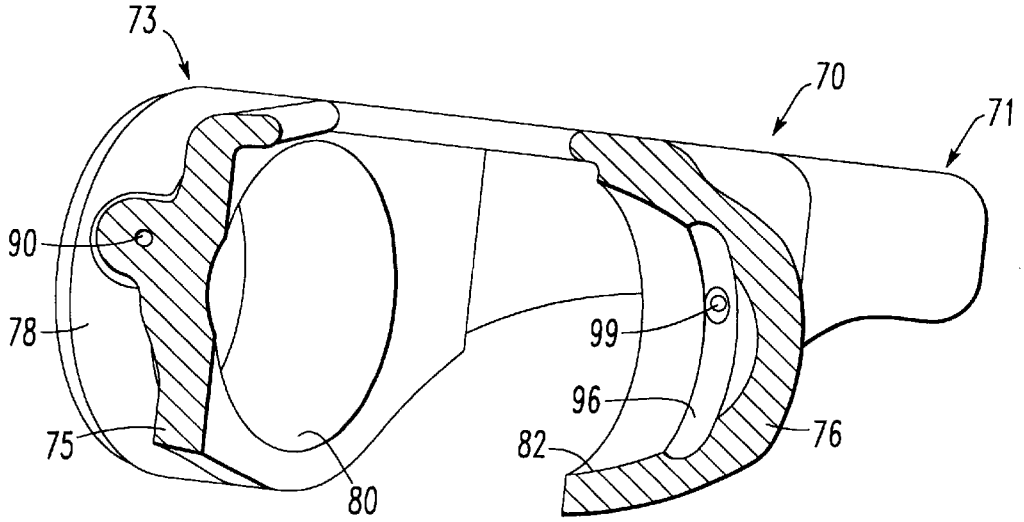
FIG. 23 is an end cross-sectional view of the rocker arm depicted in FIG. 13 taken along line XXIII—XXIII in FIG. 13.

In a preferred embodiment, cavity 86 additionally includes a lubrication port 88 in the surface thereof. As shown in FIGS. 21 and 22, a lubrication passage 90 is provided within the side wall 75 of the rocker arm 70. Passage 90 serves to interconnect the port 88 to an annular groove 92 provided in journal 76. Similarly, a second lubrication passage 94 is provided in side wall 74. Lubrication passage connects port 88 to an annular groove 96 provided in journal 78. The lubrication port 88 is positioned and sized to correspond with a lubrication channel 31 running through the length of pushrod 27 when the end 29' of pushrod 27 is received in cavity 86. See FIG. 19. Accordingly, when the end 29' of pushrod 27 is received in cavity 86, lubrication channel 31 is in fluid communication with lubrication port 88 in the rocker arm to permit lubrication liquid, such as engine oil, to flow to the annular grooves (92, 96) to reduce friction between the journals (76, 78) and the transverse rod 102. Additional ports (97, 99) may be provided as shown in FIGS. 20–22 to direct the gases and lubrication fluid toward the forward end of the rocker arm 70. The skilled artisan will appreciate that this self lubricating capability of the rocker arms of the present invention leads to improved service lives over prior rocker arm configurations.

Figure 24:
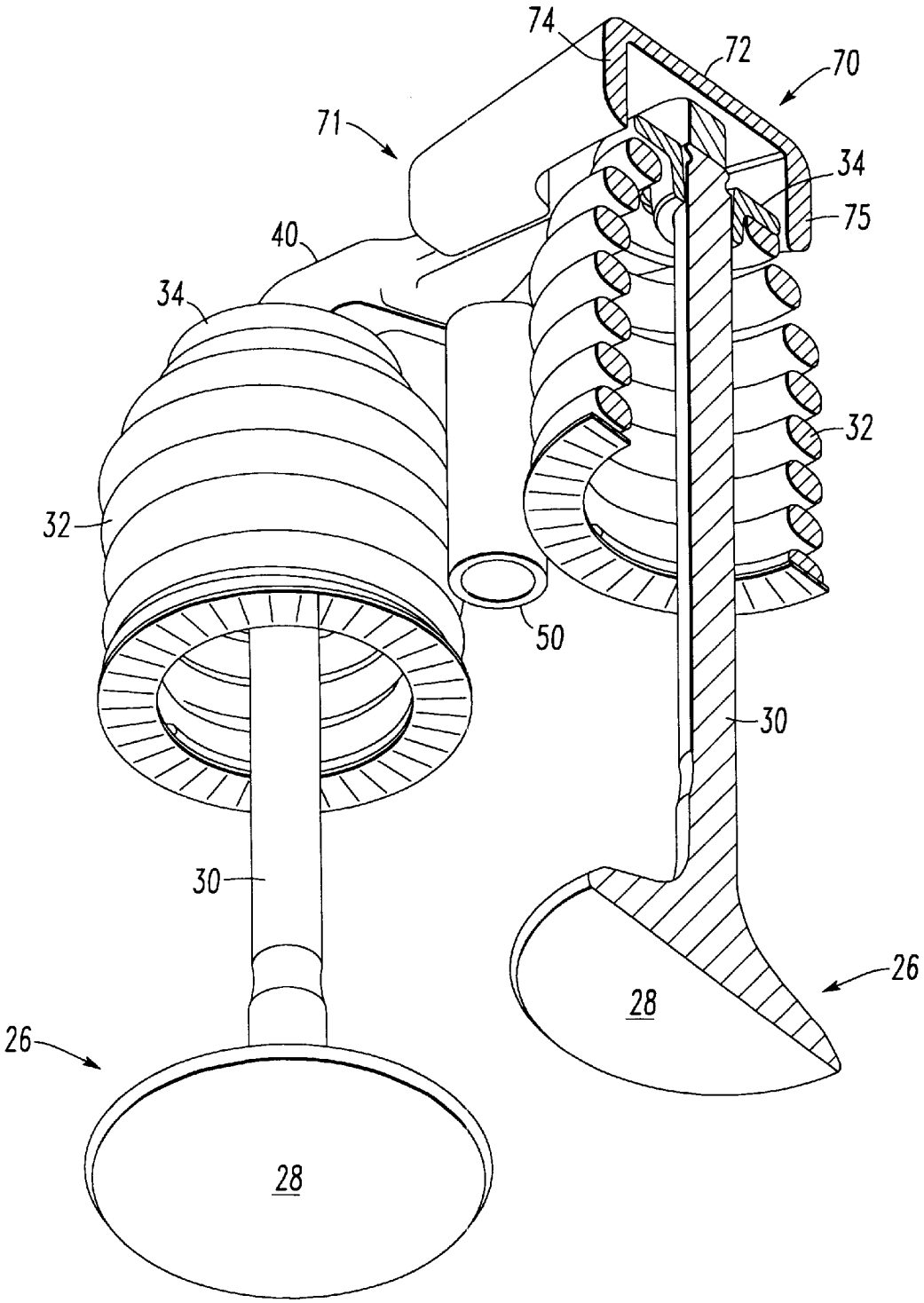
FIG. 24 is a partial perspective view of two valves and a portion of the valve actuation mechanism of the present invention.

The rocker arm 70 may also preferably include trough 95 in the bridge receiving end 71. The trough 95 forms a contact surface 97 that is adapted to accept and engage a contact area 45 formed on the bridge member 44. See FIGS. 6–8. As shown in FIG. 6, rocker arm 70 is pivotally mounted on the transverse support rod 102 such that the contact surface 97 of the rocker arm 90 engages bridge 40 at contact area 45. Contact area 45 is preferably located on the upper surface of bridge member 44 and preferably defines an arcuate surface that facilitates a slight pivot motion by the end 71 of the rocker arm 70 thereon. Accordingly, one of ordinary skill in the art will appreciate that, upon actuation, the rocker arm 70 will exert a downward actuating force on the bridge 40 that lies generally along bridge axis C—C. As can be seen in FIG. 24, the U-shaped cross-sectional configuration of a preferred rocker arm 70 of the present invention places the load carrying structure (i.e., the end 71) below the top of the valve stem 30 and spring retainer 34. Those of ordinary skill in the art will appreciate that the cross-sectional configuration of the rocker arm 70 of the present invention provides an acceptable section modulus for valve gear (e.g., rocker arm) stiffness while reducing the overall height of the engine. In a conventional arrangement, the entire cross-section of the rocker arm is located above the valve stem and spring retainer. Such conventional arrangement undesirably leads to increased engine heights. Thus, the rocker arm of the present invention represents a vast improvement over conventional rocker arm configurations.

The skilled artisan will further appreciate from the above description that the rocker arms 70 of the present invention are particularly well-suited for use in connection with the valve bridges of the present invention. However, the unique and novel rocker arms of the present invention may also be successfully employed with conventional valve bridge arrangements. Also, the rocker arms of the present invention may also be used to actuate a single valve stem without the use of a valve bridge. In such application, the contact surface of the rocker arm would directly engage the top of the valve stem to apply an actuation force thereto.

As can be appreciated from the above description, the valve actuation mechanism of the present invention provides numerous advantages over prior valve train configurations. The unique design of the present valve bridge facilitates improved engine cooling which can lead to longer part life and improved engine efficiency. The valve bridge's free floating nature requires less machining when compared to conventional "guided" bridge arrangements. The rocker arms of the present invention also provide numerous advantages over prior rocker arms. The present rocker arms have a more compact profile and, thus, require less room in the engine compartment. That compact and lightweight nature can lead to a lighter and compact engine and therefor lead to improved fuel efficiencies. Thus, from the foregoing discussion, it is apparent that the present invention solves many of the problems encountered by conventional valve actuation mechanisms. Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. An actuator for transmitting an actuation force to at least one elongated member movably received within a housing having a support cavity adjacent to at least one elongated member, said actuator comprising:

an actuator stem sized to be movably received in the support cavity along a first axis that is substantially parallel to a second axis of at least one elongated member; and a force-receiving portion attached to said actuator stem and oriented to contact at least one elongated member when a force is applied to said force receiving portion.

2. The actuator of claim 1 further comprising:

an actuator cavity within said actuator stem; and at least one orifice in said actuator stem communicating with said actuator cavity.

3. The actuator of claim 1 wherein said force receiving member is sized to contact two elongated members, when said force is applied thereto.

4. The actuator of claim 3 wherein said force receiving member has an arcuate contact surface thereon centrally disposed between the two elongated members.

5. The actuator of claim 1 wherein said actuator stem and said force receiving member are integrally formed together.

6. An actuator for transmitting an actuation force to at least one elongated member movably received within a housing, said actuator comprising:

a support cavity within the housing adjacent to at least one elongated member;

an actuator stem sized to be movably received in the support cavity such that a predetermined amount of clearance is provided therebetween; and a force-receiving portion attached to said actuator stem and oriented to contact at least one elongated member when a force is applied to said force receiving portion.

7. The actuator of claim 6 wherein said predetermined amount of clearance is substantially at least 0.002".

8. A valve bridge for applying a force to at least two valve stems that each have a stem axis and are each movably supported within an engine, said valve bridge comprising:

a support cavity in the engine adjacent at least two valve stems and defining an actuation axis that is substantially parallel to the stem axes;

a bridge stem sized to be slidably received within said support cavity;

a cross member affixed to said bridge, said cross member sized to contact two valve stems upon an application of a force to said cross member.

9. The valve bridge of claim 8 wherein a predetermined amount of clearance is provided between said actuator stem and said support cavity.

10. The valve bridge of claim 9 wherein said predetermined amount of clearance is substantially at least 0.002".

11. The valve bridge of claim 8 further comprising:

an actuation cavity within said valve stem; and at least one orifice through said valve stem into said actuation cavity.

12. The valve bridge of claim 8 wherein cross member has an arcuate surface formed therein for contact with a force transmitting member.

13. The valve bridge of claim 8 wherein said valve stem and said cross member are integrally formed together.

14. Apparatus for circulating a gas adjacent at least one valve stem that is movably supported within an engine, said apparatus comprising:

a support cavity within the engine adjacent to at least a portion of at least one valve stem;

a reciprocating actuator within said support cavity, said reciprocating actuator having an actuator cavity therein and at least one orifice through said actuator, said actuator cavity and said support cavity cooperating to form a gas chamber for receiving and expelling gas therefrom through said orifices as said actuator reciprocates within said support cavity.

15. The apparatus of claim 14 wherein said reciprocating actuator comprises:

an actuator stem slidably received within said support cavity and having said actuator cavity and orifices therein; and a cross member attached to said actuator stem, said cross member sized to contact at least two valve stems upon an application of a force to said cross member.

16. The apparatus of claim 15 wherein said cross member has an arcuate surface thereon for contact with a rocker arm.

17. An internal combustion engine comprising:

a housing;

at least two valves movably supported in said housing, each said valve having a valve stem defining a corresponding valve stem axis;

at least one support cavity within said housing centrally disposed between at least two said valve stems and defining an actuation axis that is substantially parallel to said valve stem axes;

a T-shaped valve bridge corresponding to each said support cavity and having a bridge stem sized to be slidably received within said corresponding support cavity, each said valve bridge further having a cross member sized to contact at least two said valve stems;

at least one rocker arm corresponding to each said valve bridge, each said rocker arm having a contact surface for contacting said corresponding valve bridge; and a reciprocating pushrod contacting each said rocker arm.

18. The internal combustion engine of claim 17 wherein each said valve bridge further comprises:

a bridge cavity within said bridge stem; and at least one orifice through said bridge stem into said bridge cavity.

19. The internal combustion engine of claim 18 further comprising means for circulating engine gases within the engine housing adjacent to at least to said valve stems.

20. A rocker arm for transmitting a force to at least one valve stem operably mounted within an engine, said rocker arm comprising:

a body portion having an elongated cavity formed therein;

a contact surface formed on said body portion for contacting the valve stem; and a connection portion for pivotally attaching said rocker arm to the engine, said connection portion comprising at least one journal formed on said body portion, each said journal having a bore therethrough sized to receive a portion of a transverse support rod therethrough and wherein each said journal bore has an annular passage therein that communicates with at least one lubrication passage in said body portion.

21. The rocker arm of claim 20 wherein said body portion has a U-shaped cross-section.

22. The rocker arm of claim 20 wherein said connection portion comprises a pair of journals formed on body portion for pivotally receiving a support rod therethrough.

23. The rocker arm of claim 20 wherein said body portion has a cavity therein that is sized to receive a portion of a pushrod.

24. The rocker arm of claim 20 wherein said body portion has a pushrod cavity therein sized to receive a portion of a pushrod therein and wherein lubrication passages communicate with a port in said pushrod cavity.

25. The rocker arm of claim 20 wherein said contact surface is formed in a trough located in one end of the body portion.

26. A rocker arm comprising:

a body portion having a first end, a second end, and a substantially U-shaped cross-section;

a trough in said first end; and a pushrod cavity in said second end.

27. The rocker arm of claim 26 further comprising a pair of journals formed in said body, each said journal having a bore therethrough sized to receive a portion of a support rod for pivotally attaching said body portion to a member.

28. The rocker arm of claim 26 further comprising:

an annular groove in said bores in said journals;

a lubrication port in said pushrod cavity for receiving a lubrication medium therein;

a lubrication passage in said body portion extending between said port and each said annular groove.

29. A rocker arm for transmitting an actuation force from an engine pushrod to a valve bridge oriented between a pair of piston stems protruding out of a portion of the engine housing, said rocker arm comprising:

a body portion having a recessed cavity therein sized to envelop at least a portion of the valve bridge therein;

a connector for pivotally attaching the rocker arm to the engine housing; and a contact surface on said body portion for contacting a portion of the valve bridge.

30. The rocker arm of claim 29 wherein said cavity is sized to receive at least a portion of the valve bridge and a portion of at least one valve stem therein.

31. The rocker arm of claim 30 wherein said cavity is sized to receive at least a portion of the valve bridge, a portion of at least one valve stem and at least a portion of a spring and spring retainer attached to the valve stem.

32. The rocker arm of claim 29 wherein the body portion has a first end having a trough formed therein for contacting a portion of the valve bridge and a second end having a pushrod-cavity sized to receive an end of a pushrod therein.

33. The rocker arm of claim 32 further comprising a pair of journals formed in said body, each said journal having a bore therethrough sized to receive a portion of a support rod for pivotally attaching said body portion to the engine housing.

34. The rocker arm of claim 33 further comprising:

an annular groove in said bores in said journals;

a lubrication port in said pushrod cavity for receiving a lubrication medium therein;

a lubrication passage in said body portion extending between said port and each said annular groove.

35. An internal combustion engine comprising:

an engine housing;

at least two valves movably supported in said housing and protruding therefrom;

a valve bridge operably supported on said housing between two said valve stems for contact therewith;

a rocker arm pivotally attached to said valve housing and contacting a portion of said valve bridge, said rocker arm having a recessed cavity therein for enveloping a portion of said valve bridge therein; and a reciprocating pushrod in contact with said rocker arm.

36. The internal combustion engine of claim 37 further comprising:

a transverse support rod affixed to the engine housing; and at least one journal on said rocker arm for pivotally receiving the transverse support rod therein.

37. The internal combustion engine of claim 36 wherein said support rod is affixed to said engine housing by at least one connector member and wherein said rocker arm has an opening therethrough to provided clearance for said connector member when said rocker arm pivots about said transverse support rod.

38. The internal combustion engine of claim 35 further comprising a valve stem spring around each protruding portion of said valve stems, each said valve stem spring retained in portion by a spring retainer and wherein said rocker arm cavity is sized to receive at least a portion of one said valve stem spring and spring retainer therein.

39. The internal combustion engine of claim 38 wherein at least one said valve stem spring has a conical shape.

40. An internal combustion engine comprising:

an engine housing;

at least two valves movably supported in said engine housing, each said valve having a valve stem defining a corresponding valve stem axis;

at least one support cavity within said engine housing centrally disposed between at least two said valve stems and defining an actuation axis that is substantially parallel to said valve stem axes;

a T-shaped valve bridge corresponding to each said support cavity and having a bridge stem sized to be slidably received within said corresponding support cavity, each said valve bridge further having a cross member sized to contact at least two said valve stems;

a rocker arm pivotally attached to said engine housing and contacting a portion of said valve bridge, said rocker arm having a cavity therein for receiving a portion of said valve bridge therein; and a reciprocating pushrod in contact with said rocker arm.

41. The internal combustion engine of claim 40 further comprising means for circulating lubrication gases around said valve stems.

42. A valve actuation device for an internal combustion engine having at least two valves that each have a valve stem protruding through a portion of the engine housing and serve to define valve stem axes and at least one reciprocating pushrod, said valve actuation device comprising:

a support cavity in the engine housing adjacent at least two valve stems and defining an actuation axis that is substantially parallel to the stem axes;

a bridge stem sized to be slidably received within said support cavity;

a cross member affixed to said bridge stem, said cross member sized to contact two valve stems upon an application of a force thereto;

a rocker arm pivotally attached to the engine housing for contact with the reciprocating pushrod and said valve bridge, said rocker arm having a cavity therein for receiving a portion of said valve bridge therein.

* * * * *